US008365788B2

(12) United States Patent
Le

(10) Patent No.: US 8,365,788 B2
(45) Date of Patent: Feb. 5, 2013

(54) LABEL PRINTER APPLICATOR SYSTEM

(76) Inventor: Van Loi Le, Mission Viejo, CA (US)

( * ) Notice: Subject to any disclaimer, the term of this patent is extended or adjusted under 35 U.S.C. 154(b) by 394 days.

(21) Appl. No.: 12/396,344

(22) Filed: Mar. 2, 2009

(65) Prior Publication Data

US 2010/0200159 A1 Aug. 12, 2010

Related U.S. Application Data

(63) Continuation-in-part of application No. 12/366,887, filed on Feb. 6, 2009, now abandoned.

(51) Int. Cl.
*B65C 9/42* (2006.01)

(52) U.S. Cl. ..... 156/360; 156/64; 156/235; 156/256; 156/260; 156/378; 156/379; 156/510; 156/538; 156/539; 156/552; 156/556; 156/566; 156/DIG. 2; 156/DIG. 25; 156/DIG. 27; 156/DIG. 44; 156/DIG. 45; 156/DIG. 47

(58) Field of Classification Search ..... 156/64, 156/235, 256, 360, 378, 379, 510, 538, 539, 156/552, 556, 566, DIG. 2, DIG. 25, DIG. 27, 156/DIG. 44, DIG. 45, DIG. 47
See application file for complete search history.

(56) References Cited

U.S. PATENT DOCUMENTS

| | | | | |
|---|---|---|---|---|
| 4,321,103 | A * | 3/1982 | Lindstrom et al. | 156/351 |
| 4,799,981 | A * | 1/1989 | Stone et al. | 156/64 |
| 5,232,539 | A * | 8/1993 | Carpenter et al. | 156/360 |
| 6,634,400 | B2 * | 10/2003 | Barbosa | 156/384 |
| 2005/0230479 | A1 * | 10/2005 | Chapman et al. | 235/462.13 |

* cited by examiner

*Primary Examiner* — Katarzyna Wyrozebski Lee
*Assistant Examiner* — Joshel Rivera
(74) *Attorney, Agent, or Firm* — Haynes and Boone, LLP

(57) ABSTRACT

A printer system includes a print and apply device that receives a single data stream containing label printing/encoding data and positioning data. The print and apply device transmits label data to a printer/encoder portion of the system and positioning data to motors that move the system. Once the printer portion and the applicator portion have indicated they are ready, a signal is sent to apply the label. The label can be applied anywhere in the X, Y, and/or Z directions on a package.

10 Claims, 4 Drawing Sheets

```
!PTX_SETUP
ENGINE-XYZ;600;100;0
PTX_END

~CREATE;FORM-0;144
BARCODE
C128C;INV;XRD4;4;8;8;12;12;16;16;H7;227;347
"1245678901234567890"
STOP
```

6" on X-axis – from leading edge
1" on Y-axis – from bottom of product

Fig. 3

LABEL PRINTER APPLICATOR SYSTEM

RELATED APPLICATION

This application is a Continuation-in-Part of U.S. patent application Ser. No. 12/366,887, filed Feb. 6, 2009, which is herein incorporated by references for all purposes.

BACKGROUND

1. Field of the Invention

The present invention relates to labeling systems, and in particular, to systems for applying labels to specific areas of packages or boxes.

2. Related Art

Typically, products stored in cartons or boxes are identified by a label on the outside of the carton or box. Identifying information may also be printed directly onto the carton with inkjet or any other suitable printing technology. The label may have optically readable information, such as a UPC barcode. These labels allow optical readers using a laser beam to scan the information contained thereon, such as description, price, date packaged, or any other usable data. One disadvantage of optically readable labels is that the optical reader and the label must be within a specific spatial relationship to each other, such as within a line of sight or along a perpendicular scan direction, or is limited in range by the optical reader.

A more recent type of label uses RFID or Radio Frequency Identification tags to store information. RFID uses radio frequency signals to acquire the data from the data within range of an RFID reader. RFID transponders or tags, either active or passive, are typically used with the RFID reader to read information from the RFID tag embedded in a label. RFID tags and labels can be obtained through companies such as Alien Technology Corporation of Morgan Hill, Calif.

One advantage of RFID labels is that line of sight is no longer required to read the label. This is a significant advantage since with barcodes, anything blocking the laser beam from the barcode would prevent the barcode from being read. Using radio frequencies allows RFID labels to be read through solid objects located between the RFID label and the RFID reader.

With either type of label, there may be optimal or more desirable locations on a carton, box, or package to attach the label. For example, for a decorative box to be used at a store for purchase by consumers, it may be desirable to place the label discretely on a corner so that more of the box can be used for visuals. For a carton used in a warehouse, it may be desirable to place the label near the center of the carton for ease of reading, since aesthetics would not be as important as for the store box.

However, current methods for placing a label on a box do not easily allow different placements for different size boxes for different systems. The label application system can be set for specific X and Y coordinates, but as the size, shape, and dimensions of boxes change, the labels are still placed at the same absolute X and Y coordinates. Thus, label placement may be optimal for a first box, but less than optimal for a second different box.

Accordingly, there is a need for label application systems that can apply labels onto packages that overcomes the deficiencies in the prior art as discussed above.

SUMMARY

According to one aspect of the invention, coordinate data, such as x, y, z coordinates, is first sent to a printer system, which identifies coordinates where a label is to be placed or applied on a package. The coordinate data can be sent as part of the data stream carrying the printing or encoding information for the label and can be from any third party software such as any warehouse management software, label printing software, SAP Drivers, or any database drivers. When the printer system receives this data stream, the printer system, such as through a controller, will move independent motors (e.g., x, y, and/or z axis motors) in the appropriate directions to position the applicator in the desired position. This can be done while the printer system is printing or encoding the label. Once each motor has been moved to its destination position, signals are sent back to the controller reporting the position. Once all three motors are ready, the printer system sends an apply signal to the applicator, which applies the label at the desired location on the package.

As a result, labels can be easily and quickly placed anywhere on a package. For example, two consecutive labels can be placed at the same relative position on different sized packages or at different positions on the same sized packages. This enables labels to be applied to locations most desirable for a certain package and use.

This invention will be more fully understood in conjunction with the following detailed description taken together with the following drawings.

BRIEF DESCRIPTION OF THE DRAWINGS

FIG. 3 shows an example command for use with the printer system of FIG. 1.

Use of the same or similar reference numbers in different figures indicates same or like elements.

DETAILED DESCRIPTION OF THE PREFERRED EMBODIMENTS

Figure 1:
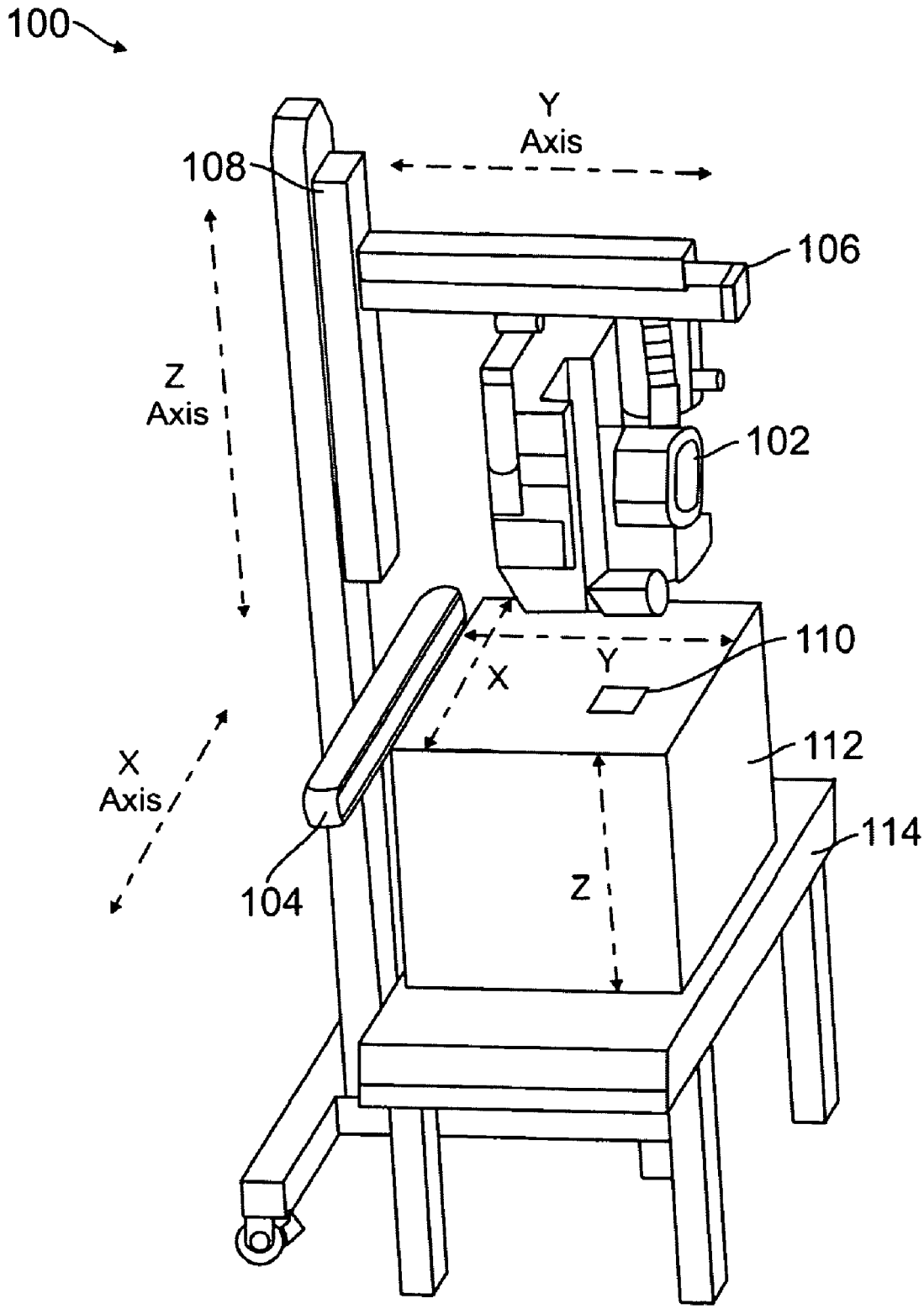
FIG. 1 shows a diagram of a printer system for applying labels according to one embodiment.

FIG. 1 shows a block diagram of a printer system 100 for applying labels to packages, according to one embodiment. System 100 includes a print and apply device or machine 102, which can receive information via a data stream from a host computer (not shown) that includes a host application, typically specific to the system through an electrical and software interface. Print and apply device 102 is commonly known and available, such as through the Printronix SLPA 8000 or Vanomation LPA 1000 models. In one embodiment, the host computer can be a conventional personal computer coupled to a local area network (LAN) or a PLC (Programmable Logic Controller connected thru serial port and/or Inputs/Outputs signals. The electrical interface can be any suitable communication means, such as, but not limited to, a serial or parallel physical link, an Ethernet connection, or a wireless link. The data stream contains various commands, such as line, box, font, and barcode commands, for printing lines, boxes, text, barcodes, and other images. The data stream is transmitted to the printer portion of print and apply machine 102 in specific languages to cause the printer to print an image on a label or other media.

Typically, each manufacturer uses a unique and specific language or software interface, such as PGL (Printronix Graphics Language used and supported by Printronix of Irvine, Calif.), ZPL (Zebra Programming Language used and supported by Zebra Technologies of Illinois), and IPL (Intermec Programming Language used and supported by Intermec of Washington). Other manufacturers with specific languages include TEC and Sato.

Print and apply machine 102 may include a printer data control section that receives the data stream and a printer engine control section for printing the label, as is known in the art. The printer engine control section manages the printer components (e.g., the print head, ribbon motors, platen motor and roller, sensors, etc.) to cause a printed image to be created on the label, based on the received image data.

Print and apply machine 102 is coupled to an X-motor 104, a Y-motor 106, and a Z-motor 108. X-motor enables print and apply machine 102 to move in the X-direction, as shown, such as by driving mechanisms or the machine itself. Similarly, Y-motor 106 and Z-motor 108 enable print and apply machine 102 to move in the Y-direction and Z-direction, respectively, as shown. With three degrees of freedom, printer system 100 is capable of applying a label 110, tag, or other article anywhere on a carton 112 or package, where carton 112 can be different sizes and heights. Details of an application process will be discussed below.

Print and apply machine 102 can include a thermal printer or any other suitable printer. The printer prints the optical information on labels as they pass through the print station. The labels may be in a roll and the roll unwound to expose each label to the print head for printing. "Suitable" printers may also include RFID devices that encode and/or write information onto an RFID tag or label. After the label is printed and/or encoded, an applicator section of machine 102 applies label 110 to carton 112. Print and apply machines are known in the art, such as available through Label-Aire, Weber, and Diagraph. RFID labels may also be encoded after being applied to carton 112.

A conveyer system 114 moves cartons 110, which can be packages, boxes, or any other items on which label 11—is to be attached. As each carton 112 passes by the applicator section of machine 102, label 110 with printed barcode or encoded RFID information is attached. Note that barcode, as used herein, may refer to any optically readable format and is not limited to barcodes. Cartons 112 can then be moved along conveyer system 114 for sorting or any other suitable processing.

As discussed above, label 110 can also be encoded with RFID information, such as from a data stream. Note that print and apply machine 102 is labeled as a unitary device. However, depending on the system and/or required function, machine 102 can be separated into two or more devices, such as for printing, encoding, applying, etc. In one embodiment, the existing information is obtained from a data stream transmitted by a host computer (not shown). The data stream can include commands, information, or instructions for printing or encoding information on a label. Print and apply machine 102 can then process the necessary signal components and use the information to print and/or encode a label.

In one embodiment, the data stream also contains information about where label 110 should be placed on carton 112. Along with EPC (Electronic Product Code) data, the data stream may also include location information on the carton. For example, this information may be the distance from the leading edge (or relative front) of the carton (X-direction in FIG. 1) and distance from the interior side of the carton (Y-direction in FIG. 1). The Z-direction may also be included within each data stream, or the Z-direction may be set at a default height, which can be changed in the data stream. X and Y direction placement may also have user-set default settings, where distance information is transmitted by the data stream only if one or more of the default settings are changed. This may occur when a different carton is placed on conveyer system 114 or when a different label placement is desired for the same carton. In other embodiments, coordinates for label placement may be sent to printer system 100 separately from the data stream.

The coordinate information, as discussed above, can be sent from a host computer incorporating any third party software such as any warehouse management software, label printing software, SAP drivers, or any database drivers. If the coordinate information is sent with the data stream, the printer system may print/encode the labels and position print and apply machine 102 at the same time, resulting in increased throughput. Once printer system 100 receives an indication, such as through confirmation signals, that both the label is ready and the applicator is properly position, print and apply machine 102 can be brought down (in the Z-direction) to apply the label. Note that the origination of print and apply machine 102 may be positioned at different locations relative to carton 112. For example, if it is desirable to apply labels to one of the sides of carton 112, print and apply machine 102 may be placed along that particular side.

Figure 2:
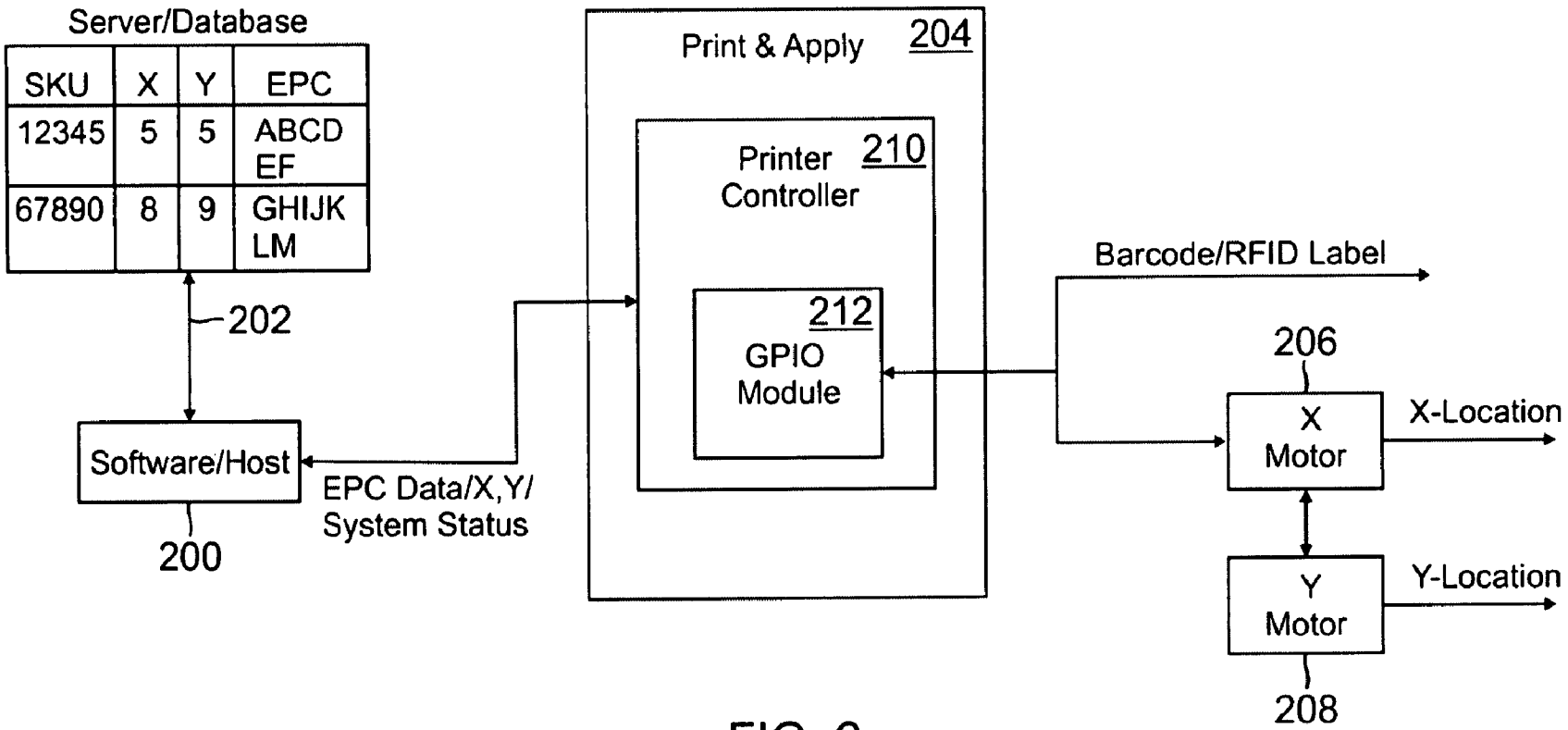
FIG. 2 is a block diagram of a portion of the printer system of FIG. 1 according to one embodiment.

FIG. 2 is a block diagram showing a portion of printer system 100 of FIG. 1. A software/host 200 communicates with a server/database 202 and print and apply machine 204. EPC and coordinate information is stored in server/database 202. Such information may be for different labels and cartons and in different languages. A user may program or write information to server/database 202 for specific printing, encoding, and/or application instructions through any suitable interface. Software/host 200 retrieves coordinate information from server/database and may also retrieve EPC data. Software/host 200 then transmits this information to print and apply machine 204, which routes EPC data to a printer/encoder portion and coordinate data to motors, such as X-motor 206 and Y-motor 208. The printer/encoder portion then prints/encodes the label, while the motors move the applicator portion to the corresponding coordinates. Once each motor positions the application portion in the desired location, a signal is sent to print and apply machine 204. Upon receiving signals from all the motors, the label is applied, assuming the label has been printed or encoded.

In one embodiment, a command parser is used to route the appropriate data to the appropriate destinations. When a data stream that includes both label data and positioning data is received, the command parser may first identify the specific commands for label printing/encoding and the specific data for applicator placement. The command parser then separates the two, and routes the label data to the printer/encoder portion of the system and routes the positioning information to the applicator portion of the system.

FIG. 3 shows an example command transmitted by software/host 200 to print and apply machine 204. The command in PGL includes instructions to place the label six inches from the leading edge (in the X-direction) and one inch from the bottom of the carton (in the Y-direction) (see FIG. 1). Also included in the command is EPC data for printing a tag. Thus, this example shows a command that includes both barcode information as well as label placement information.

Referring back to FIG. 2, print and apply machine 204 includes a printer controller 210 and a GPIO (general purpose input/output) module 212 for controlling and performing the above actions. GPIO module 212 functions similarly to an input/output intermediate controller next to printer controller 210, acting as a bridge between the printer portion and the applicator portion. GPIO module 212 can be coupled to or integrated with printer controller 210. In conventional systems, EPC data is transmitted to a print and apply device, which prints/encodes the label. Separately, and with a different interface, X and Y data is sent to a PLC/microcontroller, which controls X and Y motors for label placement. With the present invention, a single interface allows one integrated system using a synchronized approach and a single data stream containing both label and placement data.

In one embodiment, GPIO module 212 can be driven by any internal printing, encoding or verification event or by external events. Through mappings, GPIO module 212 can generate output events to drive external devices or to control printer internal activities, resulting in more effective management of functions.

Figure 4:
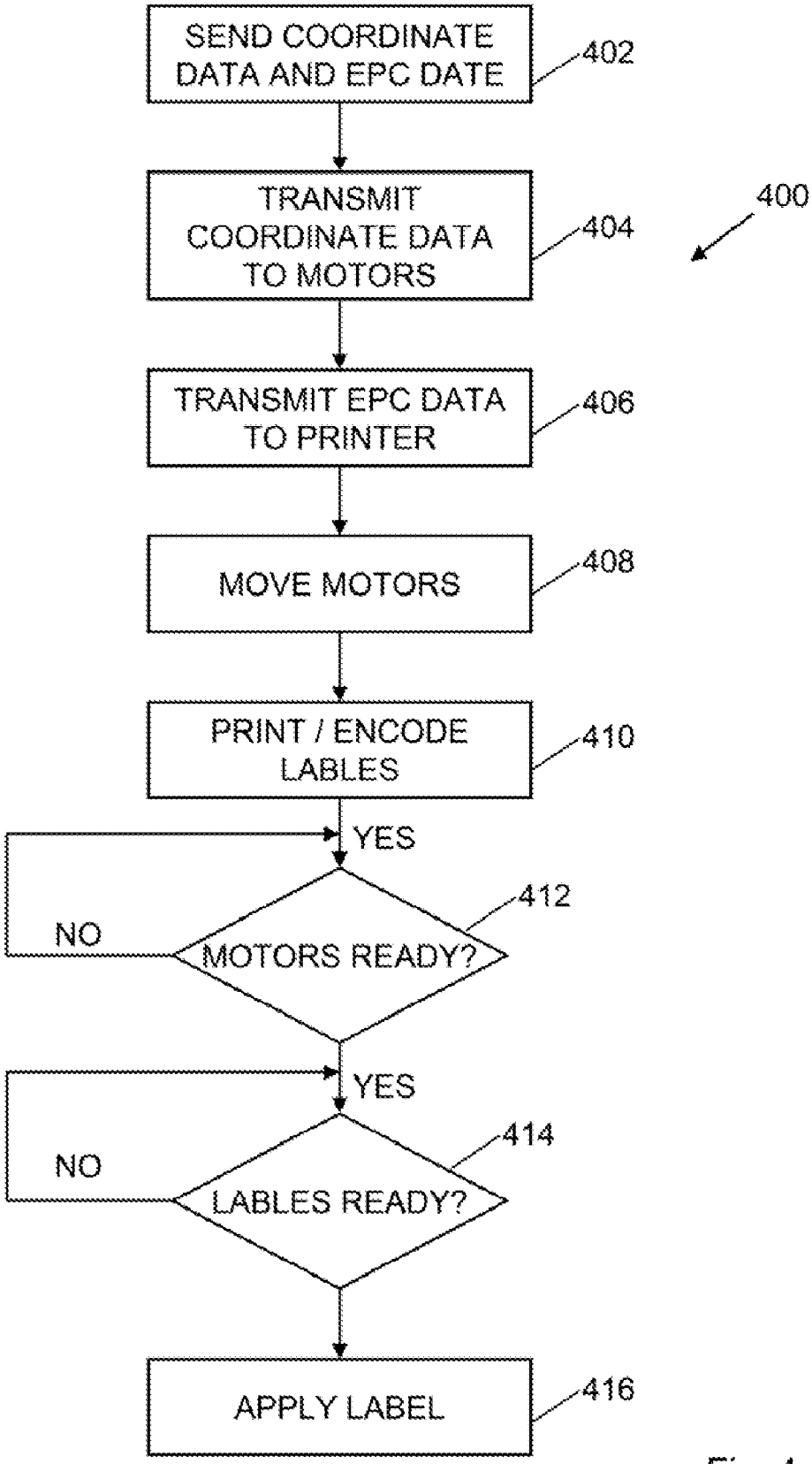
FIG. 4 is a flow chart showing a process for applying a label anywhere on a package, according to one embodiment.

FIG. 4 is a flow chart 400 showing one embodiment for applying a label anywhere on a carton or package. In step 402, label and position information are sent to a print and apply machine. The label information may contain commands, instructions, or data for printing or encoding a label. The position information may contain X, Y, and/or Z coordinates for placement of the label on the carton. Both the label and position information may be transmitted in a single data stream to the print and command machine through a single interface. Next, in step 404, the coordinate data is transmitted to individual motors (e.g., X, Y, and/or Z motors), such as by a printer controller in the print and apply machine. For example, X-coordinate data is transmitted to the X-motor, Y-coordinate data is transmitted to the Y-motor, and Z-coordinate data is transmitted to the Z-motor. Concurrently or subsequently, EPC or label data is transmitted to the printer in step 406. This data is used to instruct the printer portion how to print and/or encode the label.

Next at step 408, in response to the position information transmitted in step 404, the individual motors are moved into the desired positions. Similarly, at step 410, the printer/encoder portion of the printer system prints or encodes labels according to the EPC data received in step 406. This can be done at the same time as the motor movement of step 408. At step 412, the system determines whether the motors are ready, i.e., in the proper position for label application. In one embodiment, this determination is made by checking to see if the system receives a signal from a motor indicating that it is in the proper position. Once the system receives such a signal from each motor, then the system determines that the motors are ready. At step 414, the system determines whether the label is ready, e.g., when printing or encoding is completed. This step may take place at the same time as step 412 or before or after.

When the motors are ready (as determined in step 412) and the label is ready (as determined in step 414), the system applies the label in step 416. In one embodiment, when the label is ready to be applied, a signal is sent to the system for application of the label on the carton. Because the system has independent motors to move the applicator portion anywhere over the carton, the label can be applied anywhere on the carton. Furthermore, because the system has a single integrated controller, both the label printing/encoding information and the label positioning information can be sent to a single interface, in a single data stream. This results in a simple, easy to integrate system that enhances throughput, since label printing and applicator placement can be performed at the same time.

The above-described embodiments of the present invention are merely meant to be illustrative and not limiting. It will thus be obvious to those skilled in the art that various changes and modifications may be made without departing from this invention in its broader aspects. Therefore, the appended claims encompass all such changes and modifications as fall within the true spirit and scope of this invention.

What is claimed is:

1. A printer system, comprising:

a print and apply device configured to print or encode a label and apply the label to a package, wherein the device has a printer/encoder portion and an applicator portion;

a first motor to move the print and apply device in an X-direction;

a second motor to move the print and apply device in a Y-direction;

a third motor to move the print and apply device in a Z-direction;

a controller coupled to the print and apply device and having a single interface configured to receive a single data stream comprising label data and positioning data from a single data stream; and a command parser configured to receive the single data stream and parse label data to the printer/encoder portion and positioning data to the applicator portion.

2. The printer system of claim 1, wherein the controller is integral with the print and apply device.

3. The printer system of claim 1, wherein the data stream is received from a host device.

4. The printer system of claim 1, wherein the package can be of any size.

5. The printer system of claim 1, further comprising a conveyor to move the package across the print and apply device.

6. The printer system of claim 1, wherein the print and apply device is located above the package.

7. The printer system of claim 1, wherein the print and apply device is located along a side of the package.

8. The printer system of claim 1, wherein the positioning data comprises a first distance from a leading edge of the package.

9. The printer system of claim 1, wherein the positioning data comprises a second distance from a side edge of the package.

10. The printer system of claim 1, wherein the label is a barcode label.

* * * * *